United States Patent [19]

Keith

[11] 4,442,941

[45] Apr. 17, 1984

[54] ANTI-SPILLING DRUG CAPSULE

[75] Inventor: Alec D. Keith, Miami, Fla.

[73] Assignee: Key Pharmaceuticals, Inc., Miami, Fla.

[21] Appl. No.: 338,257

[22] Filed: Jan. 11, 1982

[51] Int. Cl.[3] ..... B65D 85/56; B65D 6/02

[52] U.S. Cl. ..... 206/540; 206/1.5; 206/530; 220/306

[58] Field of Search ..... 206/528, 540, 534, 1.5; 220/306; 40/19

[56] References Cited

U.S. PATENT DOCUMENTS

| | | | |
|---|---|---|---|
| 430,261 | 6/1890 | Altemus, Jr. | 206/1.5 |
| 1,910,074 | 5/1933 | Wells | 220/306 |
| 2,718,980 | 9/1955 | Strom | 220/306 |
| 2,858,955 | 11/1958 | Kroenert | 220/306 |
| 3,399,803 | 9/1968 | Oglevee et al. | 220/306 |
| 3,702,653 | 11/1972 | Mottin et al. | 206/534 |

*Primary Examiner*—William T. Dixson, Jr.

*Attorney, Agent, or Firm*—Wegner & Bretschneider

[57] ABSTRACT

A capsule for housing pellets is disclosed having two members, the first with a raised portion and the second with a connecting groove and an annular groove for interconnection with the raised portion to secure the two members together.

4 Claims, 2 Drawing Figures

ANTI-SPILLING DRUG CAPSULE

SUMMARY OF THE INVENTION

The present invention provides an easy to open capsule that will readily separate into its two parts, without a jerking motion that has a tendency to spill some or all of the pellets contained therein. The capsule of the present invention is in two parts, a first member having an open end and a closed end, and a second member having a closed end and an open end which is adapted to mate with the open end of the first member. An annular groove is provided on the second member, spaced from its open end. A connecting groove is provided in the second member, which has one end in communication with the annular groove and the other end extending to the open end of the second member. A raised portion on the first member is provided so that it may track along the connecting groove and the annular groove for locking the two members together or for separating them.

It is particularly contemplated that the capsule of the present invention is suited for providing a dosage unit of pellets of theophylline in a sustained release series of pellets. There are already known in the art sustained release theophylline preparations, notably THEO-DUR® (Key Pharmaceuticals, Inc., Miami, Fla.) which comprise pellets that are contained in a tablet. However, such tablets may present certain problems for the very young and the very old, a pellet from that can, for example, be mixed with food being preferred in some instances. The instant capsule is particularly designed for such sustained release theophylline (THEO-DUR SPRINKLE™, Key Pharmaceuticals, Inc., Miami, Fla.).

DESCRIPTION OF THE PREFERRED EMBODIMENT

Figure 1:
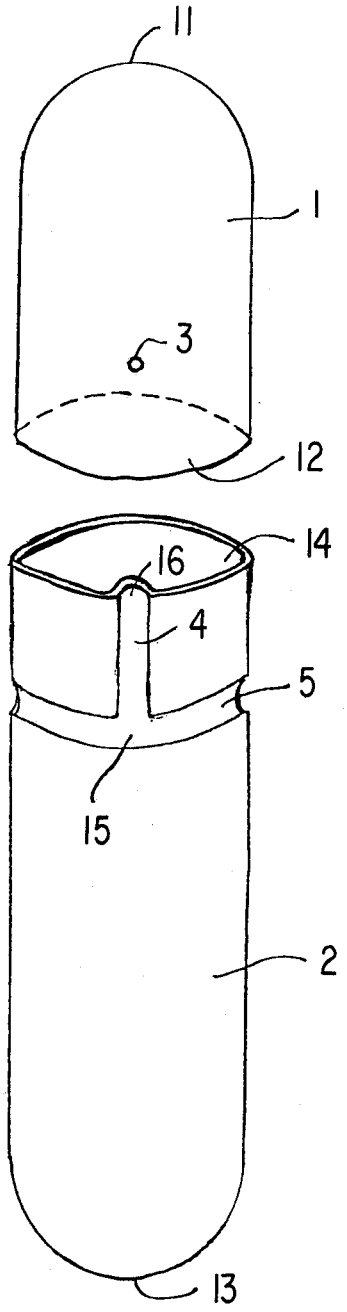
FIG. 1 is a front perspective view of the capsule showing its two parts side by side in a mating position.
Figure 2:
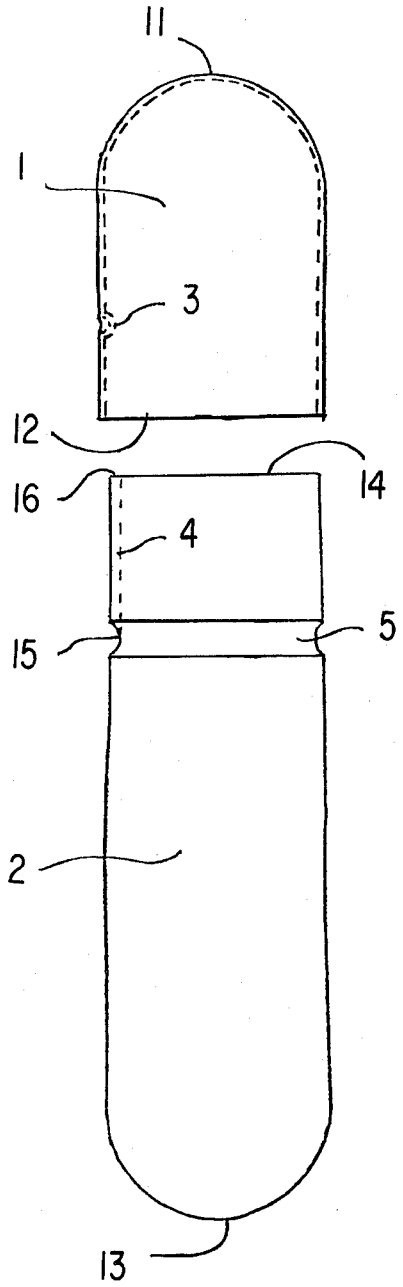
FIG. 2 is a side view of the same capsule.

The preferred embodiment of the present invention provides for two members, a first member 1 and a second member 2, to form a capsule suitable to house a plurality of pellets. First member 1 is a cylinder having a closed end 11, an open end 12 and raised portion 3, protruding inwardly from the wall of the first member 1. Second member 2 is a cylinder having a closed end 13, an open end 14, an annular groove 5 being spaced from the open end 14, and a connecting groove 4, having one end 15 in communication with groove 5 and the other end 16 extending to the open end 14. Raised portion 3 of the first member 1 is adapted to track along grooves 4 and 5 when the open end 12 of first member 1 is mated to the open end 14 of second member 2.

The present invention provides a capsule that is readily opened by twisting the first member 1 and second member 2 so that the raised portion 3 on the first member is lined up with the connecting groove 4, which permits the two members to slip apart without difficulty. When the capsule is filled with pellets of drug or other active ingredients the manufacturer mates the two members 1 and 2 by lining up the raised portion 3 with the connecting groove 4 and fits the two members 1 and 2 together so that the raised portion 3 is at the bottom of the connecting groove 4 at the point of intersection with the annular groove 5. The second member 2 is rotated relative to said first member 1 so that the raised portion 3 is in said annular groove 5 at a point remote from said connecting groove 4. While connecting groove 4 is shown, in FIG. 1, to be perpendicular to annular groove 5, this is not intended to be a limitation, as the connecting groove 4 may be disposed angularly to annular groove 5.

The resultant capsule thus securely holds the ingredients in place without spilling and without the need for a manufacturing technique that makes it difficult for the ultimate users to open the capsule when the contents are to be removed. The ultimate user to open the capsule simply lines up the raised portion 3 with the connecting groove 4 and easily pulls the two members 1 and 2 apart without any jerking motion that would tend to spill the contents.

What is claimed is:

1. A method of providing a patient with a dosage unit form of a drug comprising a plurality of pellets of the drug, which comprises incorporating said pellets into a capsule having a first member and a second member, said first member having a raised portion and said second member having a connecting groove, said connecting groove being in communication with an annular groove, both said connecting groove and said annular groove having a depth at least as great as the height of said raised portion and said annular groove having a width approximately the same as the width of said raised portion, said connecting groove touching the open end of said second member to permit mating of said raised portion with said connecting groove, said first member being locked into said second member by positioning said raised portion in said annular groove at a position remote from said connecting groove.

2. A method of claim 1 wherein said dosage unit of a drug is a plurality of coated pellets containing theophylline.

3. A capsule suitable for housing a plurality of pellets having a first member and a second member, said first member having a raised portion and said second member having a connecting communication with said annular groove, each of said connecting groove and said annular groove having a depth at least as great as the height of said raised portion and said annular groove having a width approximately the same as the width of said raised portion, said connecting groove touching the open end of said second member to permit the mating of said raised portion with said connecting groove, said first member being locked into said second member by positioning said raised portion in said annular groove at a position remote from said connecting groove.

4. A capsule suitable for housing a plurality of pellets comprising:

a first member, having an open end a closed end;

a second member, having an open end and a closed end; the open end of said second member being adapted for mating with the open end of said first member;

an annular groove on said second member, spaced from said open end;

an elongated connecting groove on said second member having one end in communication with said annular groove and a second end extending to the open end of said second member;

a raised portion on said first member extending inwardly from the interior surface thereof and adapted to tract along said annular groove and said connecting groove for locking said two members together or separating them, and said annular groove having approximately the same width as the width of said raised portion.

* * * * *